US009551480B2

(12) United States Patent
Speer et al.

(10) Patent No.: US 9,551,480 B2
(45) Date of Patent: Jan. 24, 2017

(54) TUBULAR LED LAMP WITH FLEXIBLE CIRCUIT BOARD

(71) Applicants: Richard Speer, Concord, MA (US); Kenneth Grossman, Beverly, MA (US)

(72) Inventors: Richard Speer, Concord, MA (US); Kenneth Grossman, Beverly, MA (US)

(73) Assignee: OSRAM SYLVANIA INC., Wilmington, MA (US)

( * ) Notice: Subject to any disclaimer, the term of this patent is extended or adjusted under 35 U.S.C. 154(b) by 0 days.

(21) Appl. No.: 14/835,266

(22) Filed: Aug. 25, 2015

(65) Prior Publication Data

US 2016/0084482 A1 Mar. 24, 2016

Related U.S. Application Data

(60) Provisional application No. 62/054,002, filed on Sep. 23, 2014.

(51) Int. Cl.

| | |
|---|---|
| ***F21V 19/00*** | (2006.01) |
| ***F21V 23/00*** | (2015.01) |
| ***F21V 3/04*** | (2006.01) |
| *F21V 3/02* | (2006.01) |
| *F21Y 101/00* | (2016.01) |

(52) U.S. Cl.

CPC ..... *F21V 19/004* (2013.01); *F21K 9/27* (2016.08); *F21V 3/0418* (2013.01); *F21V 23/004* (2013.01); *F21V 3/02* (2013.01); *F21Y 2101/00* (2013.01)

(58) Field of Classification Search

CPC .... F21V 19/004; F21V 3/0418; F21V 23/004; F21V 3/02; F21K 9/17; F21Y 2101/02

USPC ..... 362/222, 249.02, 249.04, 249.07, 249.11

See application file for complete search history.

(56) References Cited

U.S. PATENT DOCUMENTS

| | | | | |
|---|---|---|---|---|
| 8,262,249 | B2 * | 9/2012 | Hsia | F21V 25/04 362/217.1 |
| 9,097,408 | B2 * | 8/2015 | Su | F21V 15/01 |
| 2012/0188756 | A1 * | 7/2012 | Kokoski | F21L 14/023 362/217.05 |
| 2013/0033888 | A1 * | 2/2013 | Van Der Wel | F21V 1/06 362/555 |
| 2013/0250566 | A1 * | 9/2013 | Nishiie | F21V 13/02 362/218 |
| 2014/0240972 | A1 * | 8/2014 | Ye | F21K 9/17 362/217.13 |
| 2015/0247623 | A1 * | 9/2015 | Hikmet | F21K 9/56 362/84 |
| 2015/0285472 | A1 * | 10/2015 | Evitt | F21K 9/17 362/224 |

(Continued)

*Primary Examiner* — Laura Tso
(74) *Attorney, Agent, or Firm* — Edward S. Podszus

(57) ABSTRACT

There is herein described an LED lamp suitable for replacing conventional fluorescent lamps. The LED lamp has a tubular body and a flexible circuit board as compared to the rigid circuit boards used in other similar lamps. The flexible circuit board has a plurality of LEDs, electric circuitry for powering the LEDs, and a curvature that is maintained by a retention means. The curvature of the flexible circuit board substantially corresponds to the curvature of the tubular body which places the LEDs further away from the front surface of the lamp thereby allowing for improved diffusion and light distribution.

9 Claims, 4 Drawing Sheets

(56) References Cited

U.S. PATENT DOCUMENTS

2015/0377422 A1* 12/2015 Den Boer ..... F21K 9/17
362/223
2016/0084449 A1* 3/2016 Speer ..... F21K 9/175
362/223

* cited by examiner

TUBULAR LED LAMP WITH FLEXIBLE CIRCUIT BOARD

CROSS REFERENCE TO RELATED APPLICATION

This application claims the benefit of U.S. Provisional Application No. 62/054,002 filed Sep. 23, 2014.

BACKGROUND OF THE INVENTION

Standard linear fluorescent lamps are one of the most common lamp forms used to generate light. Given the large number of fluorescent fixtures installed in commercial, institutional, and industrial establishments, it is desirable to replace fluorescent lamps with other high efficiency, mercury-free lighting solutions having the same form factor so that replacement of the existing fixtures is not necessary. This has led to the development of solid-state replacement lamps which include linear arrays of light-emitting diodes (LEDs) on circuit boards disposed within hollow tubes. These new solid-state lamps require different construction methods than conventional fluorescent lamps and in particular novel techniques are required for mounting the circuit boards within the tubular lamp bodies.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

DETAILED DESCRIPTION

It has been found that the rigid circuit board of conventional retrofit LED lamps may be replaced with a flexible circuit board. The ability of the flexible circuit board to bend and fit concentrically to the internal diameter of the tubular body of the lamp means that a different method of mounting is needed as compared to the flat rigid circuit boards which are typically mounted to an extruded aluminum heatsink. Moreover, the use of a flexible circuit board allows the LED arrays to be positioned further away from the front surface of the lamp permitting greater diffusion of the light emitted by the individual LEDs and thereby providing a more uniform appearance. The board's curvature also permits the LEDs to be angled with respect to each other further aiding light distribution.

Figure 1A:
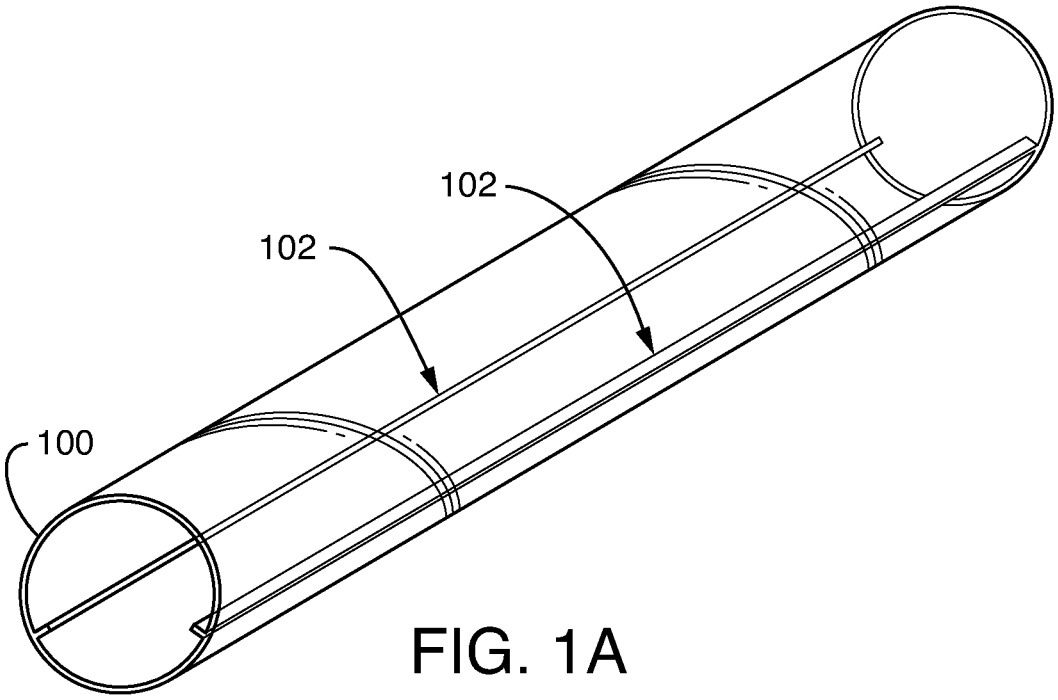
FIG. 1A is a perspective view of a tubular lamp body having a retention means in the form of longitudinal ridges.

The present invention is an LED lamp that has a retention means which maintains the curvature of the flexible circuit board within the tubular lamp body. In a first embodiment shown in FIGS. 1A-1D, the retention means comprises longitudinal ridges 102 on the interior surface 114 of tubular lamp body 100 that has a circular cross section. As shown in FIG. 1A, the longitudinal ridges 102 preferably extend along the entire length of tubular lamp body 100. Preferably, tubular lamp body 100 is a translucent plastic tube and the longitudinal ridges 102 are integrally formed with the tubular body 100, e.g., by an extrusion method.

Figure 1B:
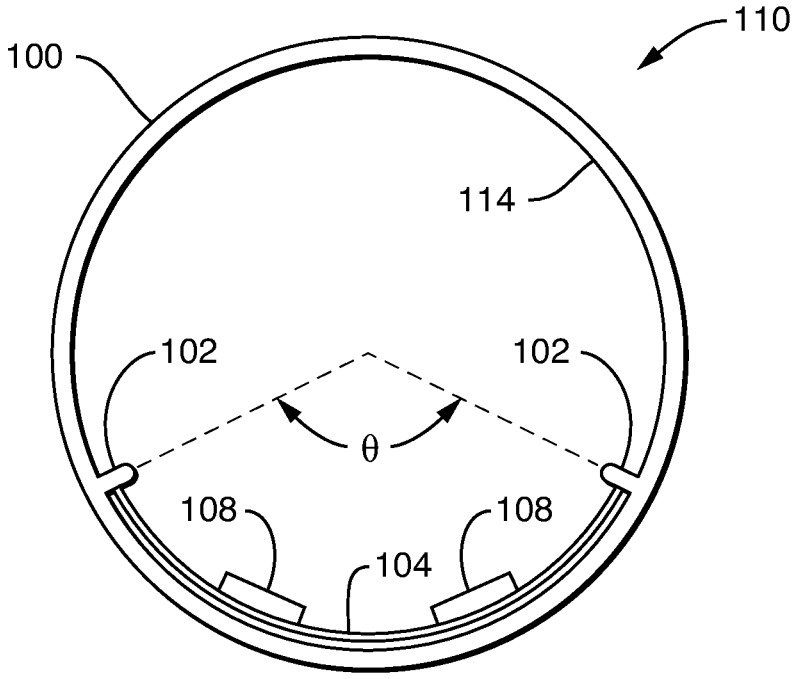
FIG. 1B is a cross sectional view of the tubular lamp body of FIG. 1A further illustrating a flexible circuit board held in place by the retention means.
Figures 1C, 1D:
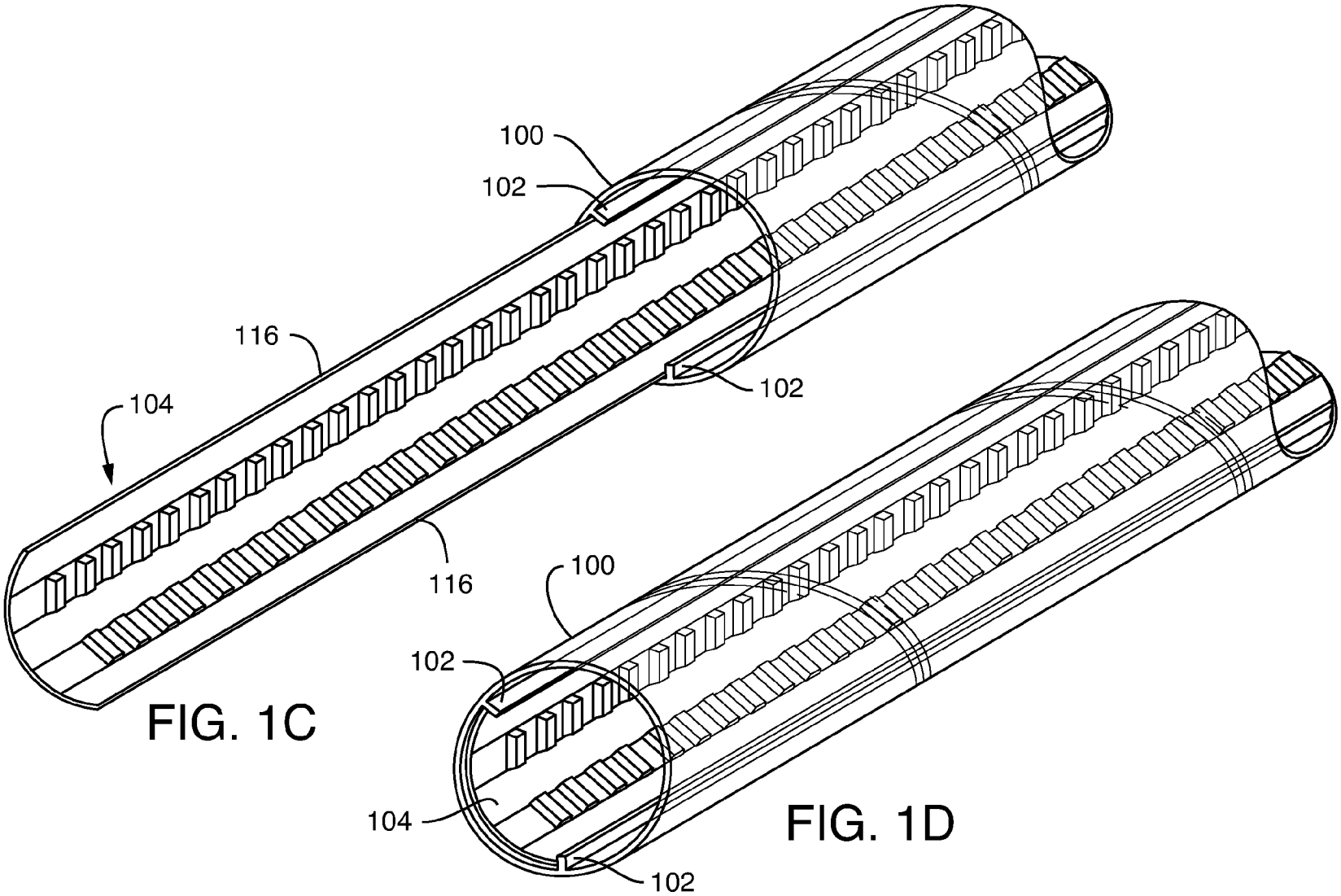
FIG. 1C is a perspective view of a flexible circuit board being inserted into the tubular lamp body shown in FIG. 1A.
FIG. 1D is a perspective view of a flexible circuit board fully inserted into the tubular lamp body of FIG. 1A.

Referring to FIG. 1B, a flexible circuit board 104 is shown retained between longitudinal ridges 102. Preferably, the flexible circuit board is comprised of a polymer material such as polyethylene terephthalate (PET). In one embodiment, the PET is a highly reflective white PET which reflects light toward the front of the lamp. More preferably, the flexible circuit board 104 is comprised of a PET material that has been thermoformed to yield a circuit board with an arcuate cross section that generally conforms to the curvature of the tube. The two longitudinal ridges 102 engage longitudinal circuit board edges 116 to retain the curved, elongated flexible circuit board 104 within the tube. As shown in FIG. 1B, the curvature of the retained flexible circuit board 104 substantially corresponds to the curvature of the tubular lamp body 100. The longitudinal ridges 102 subtend an angle θ with respect to the circular cross section of the tubular lamp body 100. Preferably, θ is about 120°. The circuit board has a plurality of LEDs 108 and electric circuitry (not shown) to provide power to the LEDs. More preferably, the tubular lamp body may be fitted with conventional fluorescent bi-pin ends caps (not shown) to provide an electrical interface that is compatible with existing fluorescent lamp fixtures. Additional electronics may also be provided within the tube or attached to one or both ends of the tube to provide AC-to-DC power conversion, current regulation, etc. The LED lamp is shown in FIG. 1D without the conventional fluorescent bi-pin end caps.

The translucent lamp body 100 functions to diffuse the light emitted by the LEDs so that the light emitted from the front surface 110 is more uniform in appearance. As shown in FIG. 1B, the LEDs 108 are positioned close to the interior surface 114 of the tubular body and relatively far away from front surface 110. This added distance enhances the diffusion of the light emitted by LEDs 108. The arcuate cross section of the flexible circuit board also serves to angle the two rows of LEDs 108 with respect to each other thereby contributing to a more uniform light distribution.

Figure 2A:
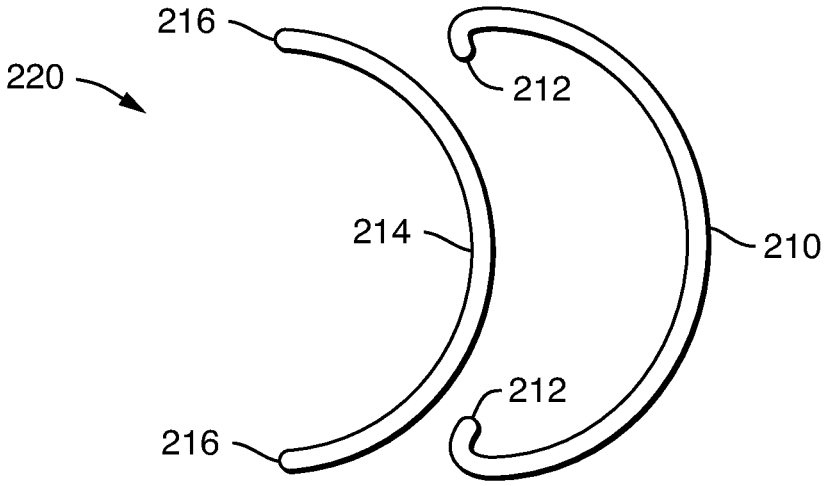
FIG. 2A is an exploded view of a retention means in the form of a clip.
Figure 2B:
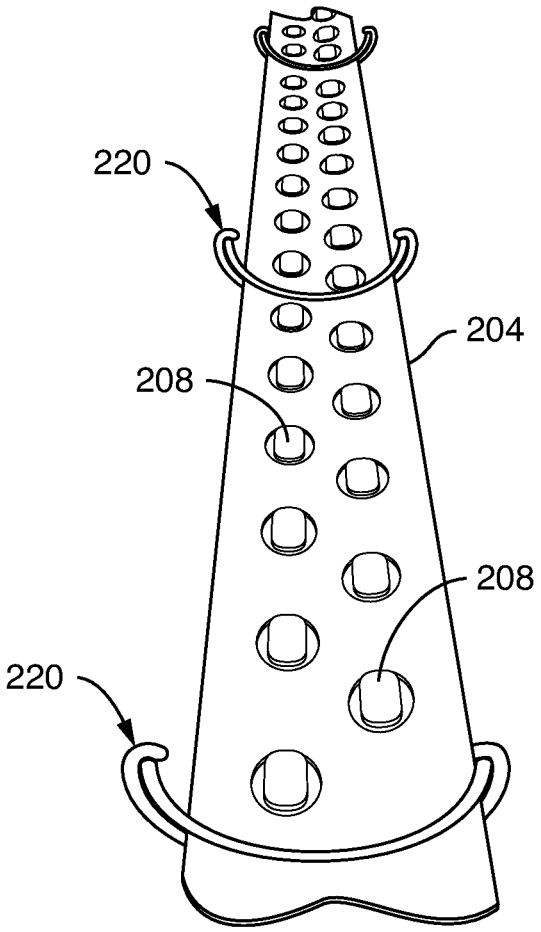
FIG. 2B is an elevation view of the retention means of FIG. 2A applied to a flexible circuit board.
Figure 2C:
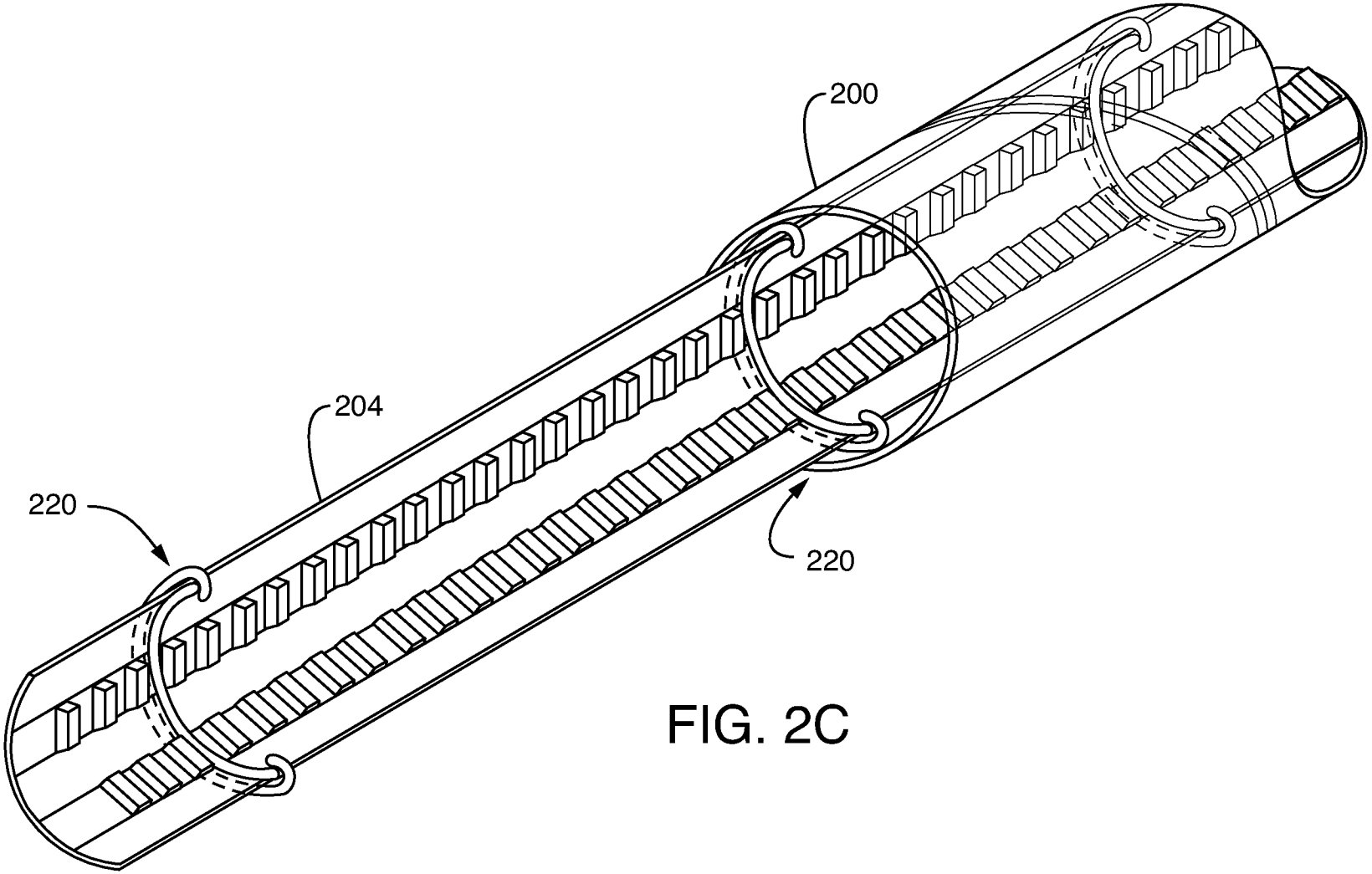
FIG. 2C is a perspective view of the flexible circuit board of FIG. 2B being inserted into a tubular lamp body.

In a second embodiment shown in FIGS. 2A-2C, the retention means is in the form of one or more clips that maintain the curvature of the flexible circuit board. The clips may be used with either a plastic tube or a glass tube since there is no need to form ridges in the tube.

Referring now to FIG. 2A, there is shown an exploded view of a clip 220 for applying to a flexible circuit board. The clip 220 is comprised of a first retention member 210 and a second retention member 214. The first retention member 210 has opposed retention edges 212 that protrude inwardly from each end of the first retention member 210. Each of the first and second retention members have an arcuate shape which preferably mimics the curvature of the tubular body of the LED lamp. Preferably, each of the first and second retention members are formed of a resilient plastic material, e.g., an ABS plastic. In operation, the retention edges 212 of the first retention member 210 engage the opposite ends 216 of the second retention member 214 whereby the second retention member fits tightly within the first retention member. The clip 220 is assembled so that the flexible circuit board 204 is between the first and second retention members 210, 214 (FIGS. 2B and 2C.) The second retention member 214 should be thin enough that it fits between the LEDs 208 on the circuit board. The clip acts to maintain a desired curvature of the flexible circuit board. Preferably, the curvature of the flexible circuit board is selected to be approximately the same as the curvature of the tubular body 200 of the LED lamp. More preferably, the clip has a size such that it must be compressed slightly to be inserted into the tubular body of the lamp which results in the clip being held in position within the tubular body by an elastic force.

Typically, the clips are applied to the flexible circuit board prior to insertion of the board into the tubular lamp body. Multiple clips may be used at spaced intervals along the length of the elongated flexible circuit board 204 which has a plurality of LEDs 208 mounted thereon. Preferably, the flexible circuit board has been thermoformed to have at least some curvature prior to attachment of the clips. The tubular lamp body 200 is preferably made of a translucent plastic however other transparent or translucent materials may be used such as glass. As above, the flexible circuit board has electric circuitry to provide power to the LEDs and the LED lamp may be completed by attaching conventional fluorescent bi-pin end caps.

In the specific embodiments discussed above, the mechanical interfaces not only hold the flexible circuit board in place but also control other performance features such as cut-off angle, and light distribution variations due to LED placement within the circular cross section of the tube. LED location can be anywhere along the arc of the flexible circuit board inside the tube which influences the eventual light distribution emitted from the lamp.

While there have been shown and described what are at present considered to be preferred embodiments of the invention, it will be apparent to those skilled in the art that various changes and modifications can be made herein without departing from the scope of the invention as defined by the appended claims.

What is claimed is:

1. An LED lamp having a tubular body and a flexible circuit board, the flexible circuit board having a plurality of LEDs, electric circuitry for powering the LEDs, and a curvature that is maintained by a retention means, the curvature of the flexible circuit board substantially corresponding to a curvature of the tubular body, and wherein the retention means comprises two longitudinal ridges that extend along the length of the tubular body; the longitudinal ridges engaging and retaining the flexible circuit board.

2. An LED lamp having a tubular body and a flexible circuit board, the flexible circuit board having a plurality of LEDs, electric circuitry for powering the LEDs, and a curvature that is maintained by a retention means, the curvature of the flexible circuit board substantially corresponding to a curvature of the tubular body, wherein the retention means comprises at least one clip, the at least one clip comprising first and second retention members having arcuate shapes, the first retention member having opposed retention edges that extend inwardly, the second retention member having opposed ends that engage the opposed retention ends of the first retention member whereby the second retention member fits tightly within the first retention member, the circuit board being disposed between the first and second retention members.

3. The LED lamp of claim 2 wherein the at least one clip is maintained in position within the tubular body by an elastic force.

4. The LED lamp of claim 1 wherein the tubular body is a translucent plastic tube and the longitudinal ridges are integrally formed with the tube.

5. The LED lamp of claim 2 wherein the clip is formed of a resilient plastic material.

6. The LED lamp of claim 2 wherein a plurality of clips are attached to the flexible circuit board.

7. The LED lamp of claim 6 wherein the tubular body comprises a glass tube.

8. The LED lamp of claim 7 wherein the tubular body is transparent.

9. The LED lamp of claim 1 wherein the flexible circuit board comprises thermoformed polyethylene terephthalate (PET).

* * * * *